US006886680B2

(12) United States Patent
King

(10) Patent No.: US 6,886,680 B2
(45) Date of Patent: May 3, 2005

(54) METHOD AND APPARATUS FOR CLASSIFYING CURRENCY ARTICLES

(75) Inventor: Katharine Louise King, Hampshire (GB)

(73) Assignee: Mars Incorporated, McLean, VA (US)

( * ) Notice: Subject to any disclaimer, the term of this patent is extended or adjusted under 35 U.S.C. 154(b) by 19 days.

(21) Appl. No.: 10/326,637

(22) Filed: Dec. 20, 2002

(65) Prior Publication Data

US 2003/0150687 A1 Aug. 14, 2003

(30) Foreign Application Priority Data

Dec. 28, 2001 (EP) ..... 01310950

(51) Int. Cl.[7] ..... G07D 7/00
(52) U.S. Cl. ..... 194/207
(58) Field of Search ..... 194/205, 206, 194/207, 302; 209/534; 706/14, 25

(56) References Cited

U.S. PATENT DOCUMENTS 4,749,076 A * 6/1988 Akagawa et al. ..... 194/207
5,330,041 A 7/1994 Dobbins et al. ..... 194/206
5,729,623 A * 3/1998 Omatu et al. ..... 382/155
6,092,059 A 7/2000 Straforini et al. ..... 706/14

FOREIGN PATENT DOCUMENTS

| | | | |
|---|---|---|---|
| EP | 0 779 604 A1 | 6/1997 | ..... G07D/7/00 |
| WO | WO 95/00932 | 1/1995 | ..... G07D/13/00 |
| WO | WO 00/10138 | 2/2000 | ..... G07D/7/12 |

* cited by examiner

*Primary Examiner*—Donald P. Walsh
*Assistant Examiner*—Mark J. Beauchaine
(74) *Attorney, Agent, or Firm*—Fish & Richardson P.C.

(57) ABSTRACT

Articles of currency are measured and the measurements then used to determine whether the articles belong to any of a plurality of respective target classes. A decision is made as to whether the article is to be rejected or accepted. A verification procedure is then carried out to determine, with greater reliability, whether the article belongs to any of the target classes, irrespective of whether the article was accepted or rejected. The verification procedure involves a plurality of measurements together with correlation data representing the expected correlations between the measurements based on populations of target classes. The selection of measurements is dependent upon the target class under consideration.

18 Claims, 4 Drawing Sheets

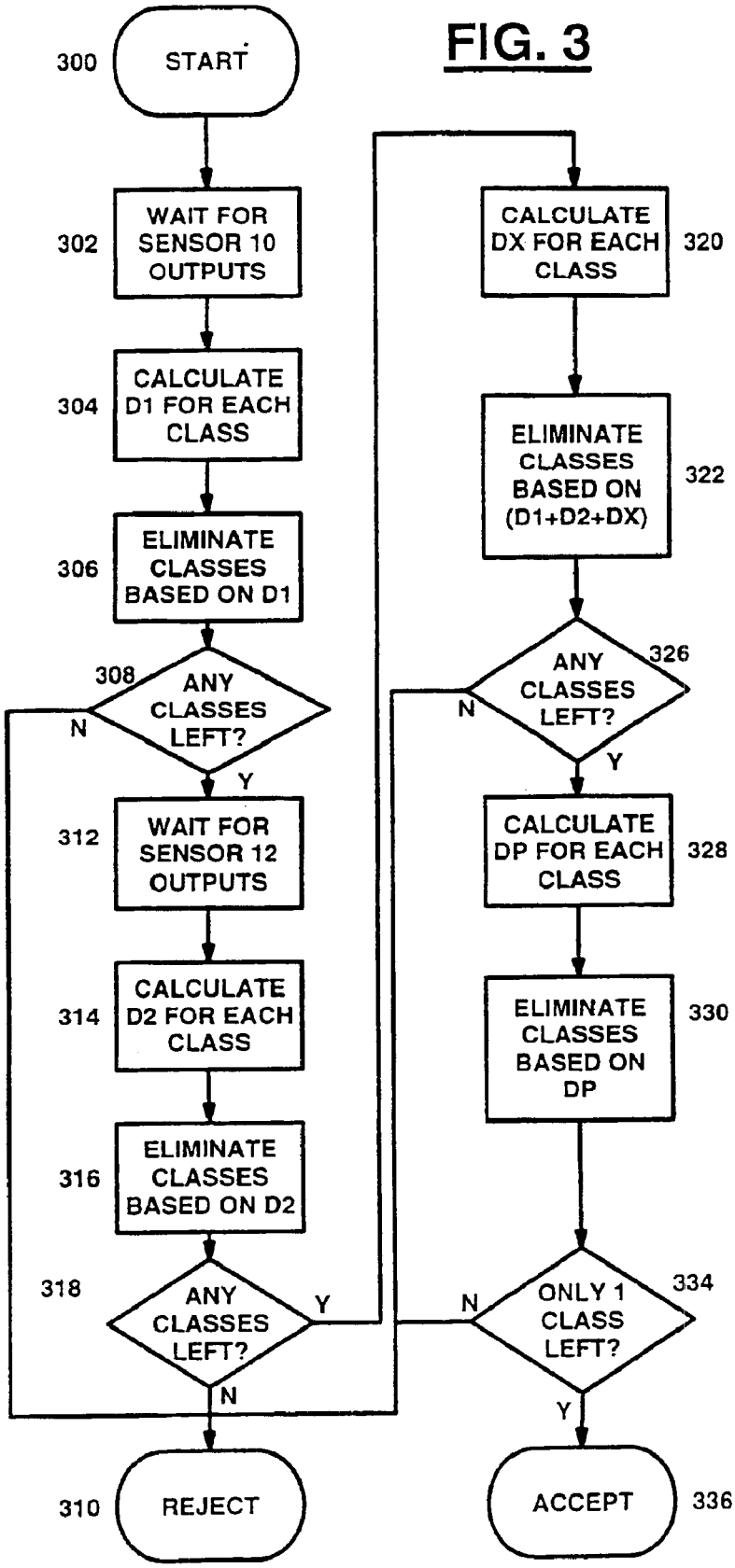
FIG. 3
300
START
302
WAIT FOR SENSOR 10 OUTPUTS
304
CALCULATE D1 FOR EACH CLASS
306
ELIMINATE CLASSES BASED ON D1
308
ANY CLASSES LEFT?
N
Y
312
WAIT FOR SENSOR 12 OUTPUTS
314
CALCULATE D2 FOR EACH CLASS
316
ELIMINATE CLASSES BASED ON D2
318
ANY CLASSES LEFT?
Y
N
310
REJECT
320
CALCULATE DX FOR EACH CLASS
322
ELIMINATE CLASSES BASED ON (D1+D2+DX)
326
ANY CLASSES LEFT?
N
Y
328
CALCULATE DP FOR EACH CLASS
330
ELIMINATE CLASSES BASED ON DP
334
ONLY 1 CLASS LEFT?
N
Y
336
ACCEPT

METHOD AND APPARATUS FOR CLASSIFYING CURRENCY ARTICLES

This invention relates to methods and apparatus for classifying articles of currency. The invention will be primarily described in the context of validating coins but is applicable also in other areas, such as banknote validation.

It is well known to take measurements of coins and apply acceptability tests to determine whether the coin is valid and the denomination of the coin. The acceptability tests are normally based on stored acceptability data. It is known to use statistical techniques for deriving the data, e.g. by feeding many items into the validator and deriving the data from the test measurements in a calibration operation.

It is also known for validators to have an automatic re-calibration function, sometimes known as "self-tuning", whereby the acceptance data is regularly updated on the basis of measurements performed during testing (see for example EP-A-0 155 126, GB-A-2 059 129, and U.S. Pat. No. 4,951,799). Accordingly, it is possible to compensate for gradual alterations in the characteristics of the testing apparatus. WO 96/36022 discloses the use of a technique (in particular calculation of Mahalanobis distances) for checking authenticity in which expected correlations between measurements are taken into account so that adjustment of acceptance parameters will take place only if an accepted currency article is highly likely to have been validated correctly.

To use Mahalanobis distances for authenticity-checking, each target class is associated with a stored set of data which, in effect, forms an inverse co-variance matrix. The data represents the correlation between the different measurements of the article. Assuming that n measurements are made, then the n resultant values are combined with the n×n inverse co-variance matrix to derive a Mahalanobis distance measurement D which represents the similarity between the measured article and the mean of a population of such articles used to derive the data set. By comparing D with a threshold, it is possible to determine the likelihood of the article belonging to the target denomination.

Although this technique is very effective, it involves many calculations and therefore requires a fast processor and/or takes a large amount of time. It is to be noted that a separate data set, and hence a separate Mahalanobis distance calculation, would be required for each target denomination. Furthermore, the time available for authenticating a coin is often very short, because the coin is moving towards an accept/reject gate and therefore the decision must be made and if appropriate the gate operated before the coin reaches the gate. For this reason, it is not common to calculate Mahalanobis distances for the purpose of determining whether to accept a currency article, although it is possible to do so (see for example GB-A-2250848). However, these problems are of lesser concern when using Mahalanobis calculations for performing a post-acceptance verification, as shown in WO 96/36022.

It would be desirable to reduce the time taken and/or the data storage requirements for performing authenticity checks (either pre- or post-acceptance) which take into account expected correlations between different measured parameters, without substantial impairment of the reliability of the checks.

It would also be desirable to improve the procedure whereby authenticity checks are performed in order to determine whether acceptance parameters are to be modified so that inappropriate modifications are more effectively avoided.

Aspects of the present invention are set out in the accompanying claims.

According to a further aspect of the invention, an authenticity test is carried out on a currency article using multiple measurements of the article and data representing correlations between those measurements in populations of target classes. For example, the test is carried out by calculating a Mahalanobis distance. This authenticity test could be used for determining whether the article is to be accepted or rejected, or could be used in a subsequent stage for making a highly-reliable determination of the class of the article in order to determine whether or not data used in making acceptance decisions should be modified in accordance with the measurements of the article. Each target class has associated therewith data defining which measurements are to be used for the Mahalanobis distance calculation. In this way, it is possible to use different parameters for the Mahalanobis distance calculation depending upon the denomination of the article, so that the most useful parameters (which may differ depending upon denomination) can be chosen. Thus, the Mahalanobis distance calculation can be simplified, and the data storage requirements reduced, by disregarding certain parameters, without substantially impairing the reliability of the results.

Preferably, at least some of the non-selected parameters, i.e. those not used in the Mahalanobis distance calculation, are individually compared against respective acceptance criteria, to avoid the possibility of an article being deemed to belong to a target class when one of the measurements is quite inappropriate for that class.

According to a further aspect of the invention, currency articles are subject to acceptance tests in order to determine whether to accept or reject them, and both accepted and rejected articles are subject to verification tests, which differ from the acceptance tests, to determine whether acceptance data used in the acceptance tests should be modified. This differs from prior art arrangements, such as WO 96/36022, in which the decision to modify the acceptance data is based on the classification of the article as a result of the acceptance tests, and possibly a verification procedure to ensure that the article is highly likely to belong to the class determined during the acceptance procedure. This aspect of the present invention allows for the possibility of re-classifying articles, including rejected articles which were not classified in the acceptance procedure.

This can have significant benefits. The currency articles which are found, during the acceptance procedure, to belong to a particular class may not be statistically representative of that class. For example, if there is a known counterfeit which closely resembles a target class, the acceptance criteria for that target class may be modified to avoid erroneous acceptance of counterfeits. This modification is likely to result in the acceptance of a greater number of articles with measurements on one side of a population mean than on the other side of the mean (at least for certain measured parameters). Accordingly, if the acceptance data were to be adjusted only on the basis of articles which pass the acceptance tests, the adjustments would be inappropriate for the population as a whole. This is avoided by using the techniques of this aspect of the invention.

An embodiment of the present invention will now be described by way of example with reference to the accompanying drawings, in which:

FIG. 3 is a flow chart showing an acceptance-determining operation of the validator.

Figure 1:
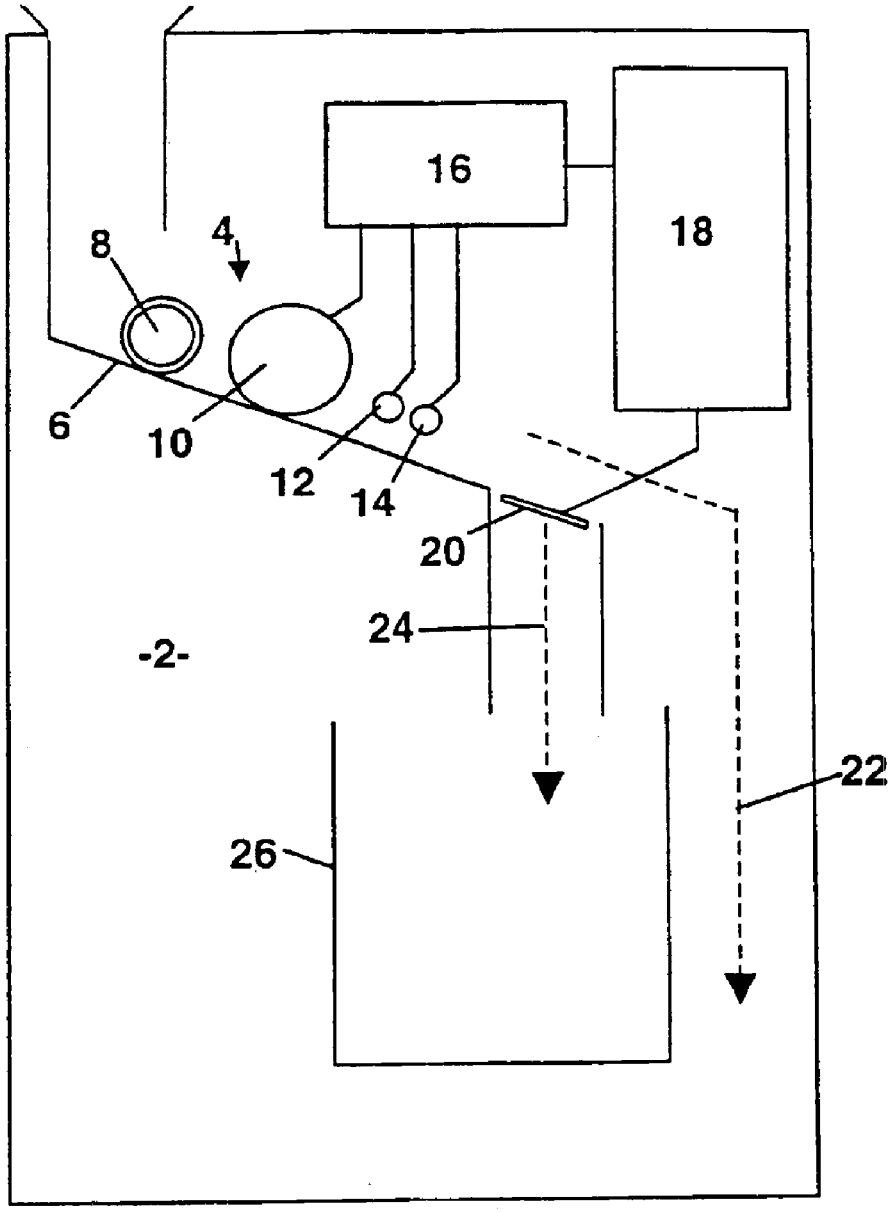
FIG. 1 is a schematic diagram of a coin validator in accordance with the invention.

Referring to FIG. 1, a coin validator 2 includes a test section 4 which incorporates a ramp 6 down which coins, such as that shown at 8, are arranged to roll. As the coin moves down the ramp 6, it passes in succession three sensors, 10, 12 and 14. The outputs of the sensors are delivered to an interface circuit 16 to produce digital values which are read by a processor 18. Processor 18 determines whether the coin is valid, and if so the denomination of the coin. In response to this determination, an accept/reject gate 20 is either operated to allow the coin to be accepted, or left in its initial state so that the coin moves to a reject path 22. If accepted, the coin travels by an accept path 24 to a coin storage region 26. Various routing gates may be provided in the storage region 26 to allow different denominations of coins to be stored separately.

In the illustrated embodiment, each of the sensors comprises a pair of electromagnetic coils located one on each side of the coin path so that the coin travels therebetween. Each coil is driven by a self-oscillating circuit. As the coin passes the coil, both the frequency and the amplitude of the oscillator change. The physical structures and the frequency of operation of the sensors 10, 12 and 14 are so arranged that the sensor outputs are predominantly indicative of respective different properties of the coin (although the sensor outputs are to some extent influenced by other coin properties).

In the illustrated embodiment, the sensor 10 is operated at 60 KHz. The shift in the frequency of the sensor as the coin moves past is indicative of coin diameter, and the shift in amplitude is indicative of the material around the outer part of the coin (which may differ from the material at the inner part, or core, if the coin is a bicolour coin).

The sensor 12 is operated at 400 KHz. The shift in frequency as the coin moves past the sensor is indicative of coin thickness and the shift in amplitude is indicative of the material of the outer skin of the central core of the coin.

The sensor 14 is operated at 20 KHz. The shifts in the frequency and amplitude of the sensor output as the coin passes are indicative of the material down to a significant depth within the core of the coin.

Figure 2:
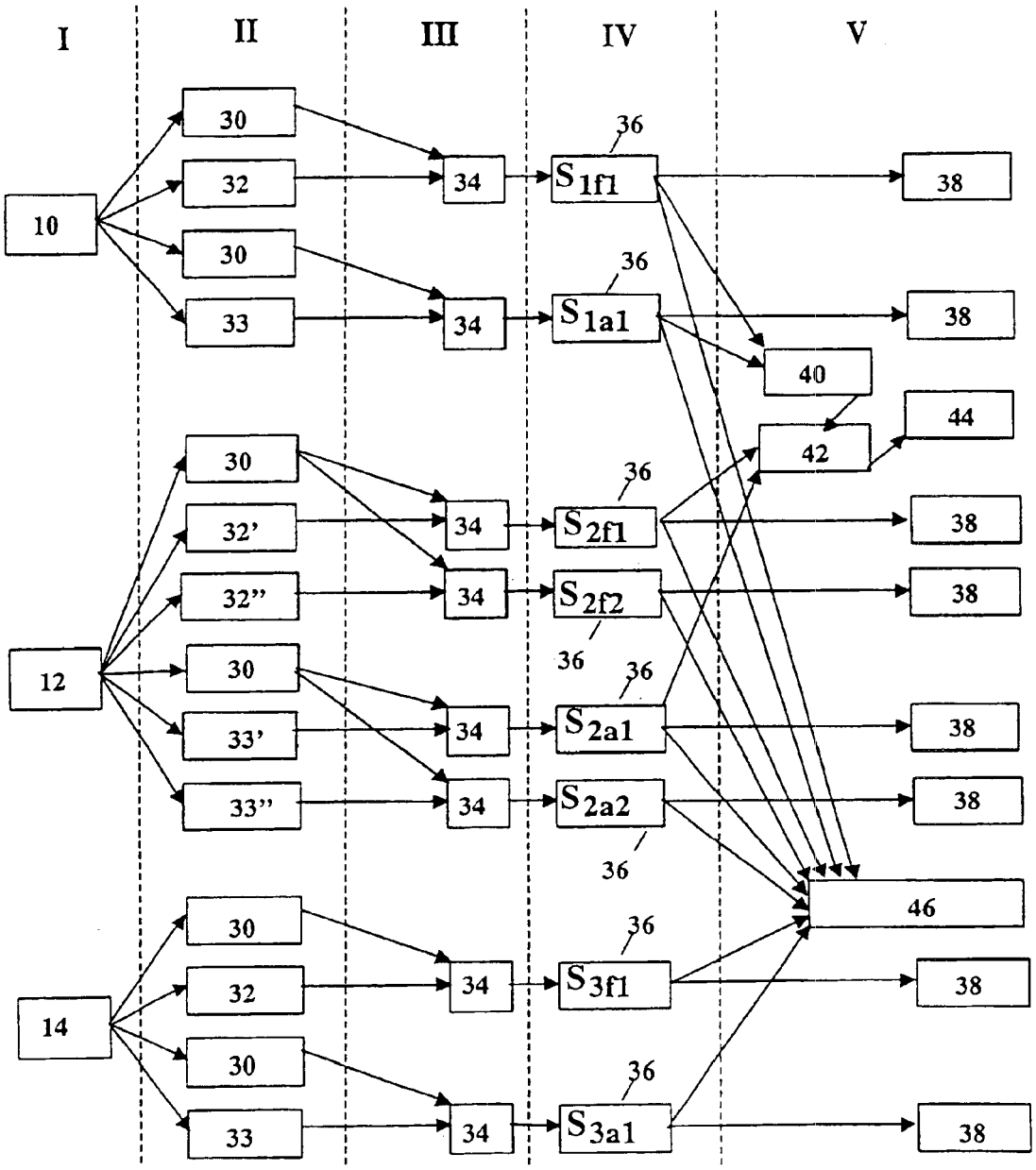
FIG. 2 is a diagram to illustrate the way in which sensor measurements are derived and processed.

FIG. 2 schematically illustrates the processing of the outputs of the sensors. The sensors 10, 12 and 14 are shown in section I of FIG. 2. The outputs are delivered to the interface circuit 16 which performs some preliminary processing of the outputs to derive digital values which are handled by the processor 18 as shown in sections II, III, IV and V of FIG. 2.

Within section II, the processor 18 stores the idle values of the frequency and the amplitude of each of the sensors, i.e. the values adopted by the sensors when there is no coin present. The procedure is indicated at blocks 30. The circuit also records the peak of the change in the frequency as indicated at 32, and the peak of the change in amplitude as indicated at 33. In the case of sensor 12, it is possible that both the frequency and the amplitude change, as the coin moves past, in a first direction to a first peak, and in a second direction to a negative peak (or trough) and again in the first direction, before returning to the idle value. Processor 18 is therefore arranged to record the value of the first frequency and amplitude peaks at 32' and 33' respectively, and the second (negative) frequency and amplitude peaks at 32" and 33" respectively.

At stage III, all the values recorded at stage II are applied to various algorithms at blocks 34. Each algorithm takes a peak value and the corresponding idle value to produce a normalised value, which is substantially independent of temperature variations. For example, the algorithm may be arranged to determine the ratio of the change in the parameter (amplitude or frequency) to the idle value. Additionally, or alternatively, at this stage III the processor 18 may be arranged to use calibration data which is derived during an initial calibration of the validator and which indicates the extent to which the sensor outputs of the validator depart from a predetermined or average validator. This calibration data can be used to compensate for validator-to-validator variations in the sensors.

At stage IV, the processor 18 stores the eight normalised sensor outputs as indicated at blocks 36. These are used by the processor 18 during the processing stage V which determines whether the measurements represent a genuine coin, and if so the denomination of that coin. The normalised outputs are represented as $S_{ijk}$ where:

i represents the sensor (1=sensor 10, 2=sensor 12 and 3=sensor 14), j represents the measured characteristic (f=frequency, a=amplitude) and k indicates which peak is represented (1=first peak, 2=second (negative) peak).

It is to be noted that although FIG. 2 sets out how the sensor outputs are obtained and processed, it does not indicate the sequence in which these operations are performed. In particular, it should be noted that some of the normalised sensor values obtained at stage IV will be derived before other normalised sensor values, and possibly even before the coin reaches some of the sensors. For example the normalised sensor values $S_{1f1}$, $S_{1a1}$ derived from the outputs of sensor 10 will be available before the normalised outputs $S_{2f1}$, $S_{2a1}$ derived from sensor 12, and possibly before the coin has reached sensor. 12.

Referring to section V of FIG. 2, blocks 38 represent the comparison of the normalised sensor outputs with predetermined ranges associated with respective target denominations. This procedure of individually checking sensor outputs against respective ranges is conventional.

Block 40 indicates that the two normalised outputs of sensor 10, $S_{1f1}$ and $S_{1a1}$, are used to derive a value for each of the target denominations, each value indicating how close the sensor outputs are to the mean of a population of that target class. The value is derived by performing part of a Mahalanobis distance calculation.

In block 42, another two-parameter partial Mahalanobis calculation is performed, based on two of the normalised sensor outputs of the sensor 12, $S_{2f1}$, $S_{2a1}$ (representing the frequency and amplitude shift of the first peak in the sensor output).

At block 44, the normalised outputs used in the two partial Mahalanobis calculations performed in blocks 40 and 42 are combined with other data to determine how close the relationships between the outputs are to the expected mean of each target denomination. This further calculation takes into account expected correlations between each of the sensor outputs $S_{1f1}$, $S_{1a1}$ from sensor 10 with each of the two sensor outputs $S_{2f1}$, $S_{2a1}$ taken from sensor 12. This will be explained in further detail below.

At block 46, potentially all normalised sensor output values can be weighted and combined to give a single value which can be checked against respective thresholds for different target denominations. The weighting coefficients, some of which may be zero, will be different for different target denominations.

The operation of the validator will now be described with reference to FIG. 3.

This procedure will employ an inverse co-variance matrix which represents the distribution of a population of coins of a target denomination, in terms of four parameters represented by the two measurements from the sensor 10 and the first two measurements from the sensor 12.

Thus, for each target denomination there is stored the data for forming an inverse co-variance matrix of the form:

$$M = \begin{matrix} mat1,1 & mat1,2 & mat1,3 & mat1,4 \\ mat2,1 & mat2,2 & mat2,3 & mat2,4 \\ mat3,1 & mat3,2 & mat3,3 & mat3,4 \\ mat4,1 & mat4,2 & mat4,3 & mat4,4 \end{matrix}$$

This is a symmetric matrix where mat x,y=mat y,x, etc. Accordingly, it is only necessary to store the following data:

$$\begin{matrix} mat1,1 & mat1,2 & mat1,3 & mat1,4 \\ & mat2,2 & mat2,3 & mat2,4 \\ & & mat3,3 & mat3,4 \\ & & & mat4,4 \end{matrix}$$

For each target denomination there is also stored, for each property m to be measured, a mean value $x_m$.

The procedure illustrated in FIG. 3 starts at step 300, when a coin is determined to have arrived at the testing section. The program proceeds to step 302, whereupon it waits until the normalised sensor outputs $S_{1f1}$ and $S_{1a1}$ from the sensor 10 are available. Then, at step 304, a first set of calculations is performed. The operation at step 304 commences before any normalised sensor outputs are available from sensor 12.

At step 304, in order to calculate a first set of values, for each target class the following partial Mahalanobis calculation is performed:

$$D1=\text{mat}1,1\cdot\partial1\cdot\partial1+\text{mat}2,2\cdot\partial2\cdot2+2\cdot(\text{mat}1,2\cdot\partial1\cdot\partial2)$$

where $\partial1=S_{1f1}-x_1$ and $\partial2=S_{1a1}-x_2$, and $x_1$ and $x_2$ are the stored means for the measurements $S_{1f1}$ and $S_{1a1}$ for that target class.

The resulting value is compared with a threshold for each target denomination. If the value exceeds the threshold, then at step 306 that target denomination is disregarded for the rest of the processing operations shown in FIG. 3.

It will be noted that this partial Mahalanobis distance calculation uses only the four terms in the top left section of the inverse co-variance matrix M.

Following step 306, the program checks at step 308 to determine whether there are any remaining target classes following elimination at step 306. If not, the coin is rejected at step 310.

Otherwise, the program proceeds to step 312, to wait for the first two normalised outputs $S_{2f1}$ and $S_{2a1}$ from the sensor 12 to be available.

Then, at step 314, the program performs, for each remaining target denomination, a second partial Mahalanobis distance calculation as follows:

$$D2=\text{mat}3,3\cdot\partial3\cdot3+\text{mat}4,4\cdot\partial4\cdot\partial4+2\cdot(\text{mat}3,4\cdot\partial3\cdot\partial4)$$

where $\partial3=S_{2f1}-x_3$ and $\partial4=S_{2a1}-x_4$, and $x_3$ and $x_4$ are the stored means for the measurements $S_{2f1}$ and $S_{2a1}$ for that target class.

This calculation therefore uses the four parameters in the bottom right of the inverse co-variance matrix M.

Then, at step 316, the calculated values D2 are compared with respective thresholds for each of the target denominations and if the threshold is exceeded that target denomination is eliminated. Instead of comparing D2 to the threshold, the program may instead compare (D1+D2) with appropriate thresholds.

Assuming that there are still some remaining target denominations, as checked at step 318, the program proceeds to step 320. Here, the program performs a further calculation using the elements of the inverse co-variance matrix M which have not yet been used, i.e. the cross-terms principally representing expected correlations between each of the two outputs from sensor 10 with each of the two outputs from sensor 12. The further calculation derives a value DX for each remaining target denomination as follows:

$$DX=2\cdot(\text{mat}1,3\cdot\partial1\cdot\partial3+\text{mat}1,4\cdot\partial1\cdot\partial4+\text{mat}2,3\cdot\partial2\cdot\partial3+\text{mat}2,4\cdot\partial2\cdot\partial4)$$

Then, at step 322, the program compares a value dependent on DX with respective thresholds for each remaining target denomination and eliminates that target denomination if the threshold is exceeded. The value used for comparison may be DX (in which case it could be positive or negative). Preferably however the value is D1+D2+DX. The latter sum represents a full four-parameter Mahalanobis distance taking into account all cross-correlations between the four parameters being measured.

At step 326 the program determines whether there are any remaining target denominations, and if so proceeds to step 328. Here, for each target denomination, the program calculates a value DP as follows:

$$DP=\sum_{n=1}^{8}\partial_n\cdot a_n$$

where $\partial_1 \ldots \partial_8$ represent the eight normalised measurements $S_{i,j,k}$ and $a_1 \ldots a_8$ are stored coefficients for the target denomination. The values DP are then at step 330 compared with respective ranges for each remaining target class and any remaining target classes are eliminated depending upon whether or not the value falls within the respective range. At step 334, it is determined whether there is only one remaining target denomination. If so, the coin is accepted at step 336. The accept gate is opened and various routing gates are controlled in order to direct the coin to an appropriate destination. Otherwise, the program proceeds to step 310 to reject the coin. The step 310 is also reached if all target denominations are found to have been eliminated at step 308, 318 or 326.

The procedure explained above does not take into account the comparison of the individual normalised measurements with respective window ranges at blocks 38 in FIG. 2. The procedure shown in FIG. 3 can be modified to include these steps at any appropriate time, in order to eliminate further the number of target denominations considered in the succeeding stages. There could be several such stages at different points within the program illustrated in FIG. 3, each for checking different measurements. Alternatively, the individual comparisons could be used as a final boundary check to make sure that the measurements of a coin about to be accepted fall within expected ranges. As a further alternative, these individual comparisons could be omitted.

In a modified embodiment, at step 314 the program selectively uses either the measurements $S_{2f1}$ and $S_{2a1}$ (representing the first peak from the second sensor) or the measurements $S_{2f2}$ and $S_{2a2}$ (representing the second peak from the second sensor), depending upon the target class.

There are a number of advantages to performing the Mahalanobis distance calculations in the manner set out above. It will be noted that the number of calculations performed at stages 304, 314 and 320 progressively decreases as the number of target denominations is reduced. Therefore, the overall number of calculations performed as compared with a system in which a full four-parameter Mahalanobis distance calculation is carried out for all target denominations is substantially reduced, without affecting discrimination performance. Furthermore, the first calculation at step 304 can be commenced before all the relevant measurements have been made.

The sequence can however be varied in different ways. For example, steps 314 and 320 could be interchanged, so that the cross-terms are considered before the partial Mahalanobis distance calculations for measurements $\partial 3$ ($=S_{2f1}-x_3$) and $\partial 4$ ($=S_{2a1}-x_4$) are performed. However, the sequence described with reference to FIG. 3 is preferred because the calculated values for measurements $\partial 3$ and $\partial 4$ are likely to eliminate more target classes than the cross-terms.

In the arrangement described above, all the target classes relate to articles which the validator is intended to accept. It would be possible additionally to have target classes which relate to known types of counterfeit articles. In this case, the procedure described above would be modified such that, at step 334, the processor 18 would determine (a) whether there is only one remaining target class, and if so (b) whether this target class relates to an acceptable denomination. The program would proceed to step 336 to accept the coin only if both of these tests are passed; otherwise, the coin will be rejected at step 310.

Following the acceptance procedure described with reference to FIG. 3, the processor 18 carries out a verification procedure which is set out in FIG. 4.

The verification procedure starts at step 338, and it will be noted that this is reached from both the rejection step 310 and the acceptance step 336, i.e. the verification procedure is applied to both rejected and accepted currency articles. At step 338, an initialisation procedure is carried out to set a pointer TC to refer to the first one of the set of target classes for which acceptance data is stored in the validator.

At step 340, the processor 18 selects five of the normalised measurements $S_{i,j,k}$. In order to perform this selection, the validator stores, for each target class, a table containing five entries, each entry storing the indexes i, j, k of the respective one of the measurements to be selected. Then, the processor 18 derives P, which is a 1×5 matrix [p1,p2,p3,p4, p5] each element of which represents the difference between a selected normalised measurement $S_{i,j,k}$ of a property and a stored average $x_m$ of that property of the current target class.

The processor 18 also derives $P^T$, which is the transpose of P, and retrieves from a memory values representing M', which is a 5×5 symmetric inverse covariance matrix representing the correlation between the 5 different selected measurements P in a population of coins of the current target class:

$$M' = \begin{matrix} mat'1,1 & mat'1,2 & mat'1,3 & mat'1,4 & mat'1,5 \\ mat'2,1 & mat'2,2 & mat'2,3 & mat'2,4 & mat'2,5 \\ mat'3,1 & mat'3,2 & mat'3,3 & mat'3,4 & mat'3,5 \\ mat'4,1 & mat'4,2 & mat'4,3 & mat'4,4 & mat'4,5 \\ mat'5,1 & mat'5,2 & mat'5,3 & mat'5,4 & mat'5,5 \end{matrix}$$

As with the matrix M, matrix M' is symmetric, and therefore it is not necessary to store separately every individual element.

Also, at step 340, the processor 18 calculates a Mahalanobis distance DC such that:

$$DC=P\cdot M'\cdot P^T$$

The calculated five-parameter Mahalanobis distance DC is compared at step 342 with a stored threshold for the current target class. If the distance DC is less than the threshold then the program proceeds to step 344.

Otherwise, it is assumed that the article does not belong to the current target class and the program proceeds to step 346. Here, the processor checks to see whether all the target classes have been checked, and if not proceeds to step 348. Here, the pointer is indexed so as to indicate the next target class, and the program loops back to step 340.

In this way, the processor 18 successively checks each of the target classes. If none of the target classes produces a Mahalanobis distance DC which is less than the respective threshold, then after all target classes have been checked as determined at step 346, the processor proceeds to step 350, which terminates the verification procedure.

However, if for any target class it is determined at step 342 that the Mahalanobis distance DC is less than the respective threshold for that class, the program proceeds to step 344. Here, the processor 18 retrieves all the non-selected measurements $S_{i,j,k}$, together with respective ranges for these measurements, which ranges form part of the acceptance data for the respective target class.

Then, at step 352, the processor determines whether all the non-selected property measurements $S_{i,j,k}$ fall within the respective ranges. If not, the program proceeds to step 346. However, if all the property measurements fall within the ranges, the program proceeds to step 354.

Before deciding that the article belongs to the current target class, the program first checks the measurements to see if they resemble the measurements expected from a different target class. For this purpose, for each target class, there is a stored indication of the most closely similar target class (which might be a known type of counterfeit). At step 354, the program calculates a five-parameter Mahalanobis distance DC' for this similar target class. At step 356, the program calculates the ratio DC/DC'. If the ratio is high, this means that the measurements resemble articles of the current target class more than they resemble articles of the similar target class. If the ratio is low, this means that they articles may belong to the similar target class, instead of the current target class.

Accordingly, if DC/DC' exceeds a predetermined threshold, the program deems the article to belong to the current target class and proceeds to step 358; otherwise, the program proceeds to terminate at step 350.

If desired, for some target classes steps 354 and 356 may be repeated for respective different classes which closely resemble the target class. The steps 354 and 356 may be omitted for some target classes.

At step 358, the processor 18 performs a modification of the stored acceptance data associated with the current target class, and then the program ends at step 350.

The modification of the acceptance data carried out at step 358 takes into account the measurements $S_{i,j,k}$ of the accepted article. Thus, the acceptance data can be modified to take into account changes in the measurements caused by drift in the component values. This type of modification is referred to as a "self-tuning" operation.

It is envisaged that at least some of the data used in the acceptance stage described with respect to FIG. 3 will be altered. Preferably, this will include the means $x_m$, and it may also include the window ranges considered at blocks 38 in FIG. 2 and possibly also the values of the matrix M. The means $x_m$ used in the acceptance procedure of FIG. 3 are preferably the same values that are also used in the verification procedure of FIG. 4, so the adjustment may also have an effect on the verification procedure. In addition, data which is used exclusively for the verification procedure, e.g. the values of the matrix M' or the ranges considered at step 352, may also be updated.

In the embodiment described above, the data modification performed at step 358 involves only data related to the target class to which the article has been verified as belonging. It is to be noted that:

(1) The data for a different target class may alternatively or additionally be modified. For example, the target class may represent a known type of counterfeit article, in which case the data modification carried out at step 358 may involve adjusting the data relating to a target class for a genuine article which has similar properties, so as to reduce the risk of counterfeits being accepted as such a genuine article.

(2) The modifications performed at step 358 may not occur in every situation. For example, there may be some target classes for which no modifications are to be performed. Further, the arrangement may be such that data is modified only under certain circumstances, for example only after a certain number of articles have been verified as belonging to the respective target class, and/or in dependence upon the extent to which the measured properties differ from the means of the target class.

(3) The extent of the modifications made to the data is preferably determined by the measured values $S_{i,j,k}$, but instead may be a fixed amount so as to control the rate at which the data is modified.

(4) There may be a limit to the number of times (or the period in which) the modifications at step 358 are permitted, and this limit may depend upon the target class.

(5) The detection of articles which closely resemble a target class but are suspected of not belonging to the target class may disable or suspend the modifications of the target class data at step 358. For example, if the check at step 356 indicates that the article may belong to a closely-similar class, modifications may be suspended. This may occur only if a similar conclusion is reached several times by step 356 without a sufficient number of intervening occasions indicating that an article of the relevant target class has been received (indicating that attempts are being made to defraud the validator). Suspension of modifications may be accompanied by a (possibly temporary) tightening of the acceptance criteria.

It is to be noted that the measurements selected to form the elements of P will be dependent on the denomination of the accepted coin. Thus, for example, for a denomination R, it is possible that $p1=\partial 1=S_{1f1}-x_1$, whereas for a different denomination $p1=\partial 8=S_{3a1}-x_8$ (where $x_8$ is the stored mean for the measurement $S_{3a1}$). Accordingly, the processor 18 can select those measurements which are most distinctive for the denomination being confirmed.

Figure 4:
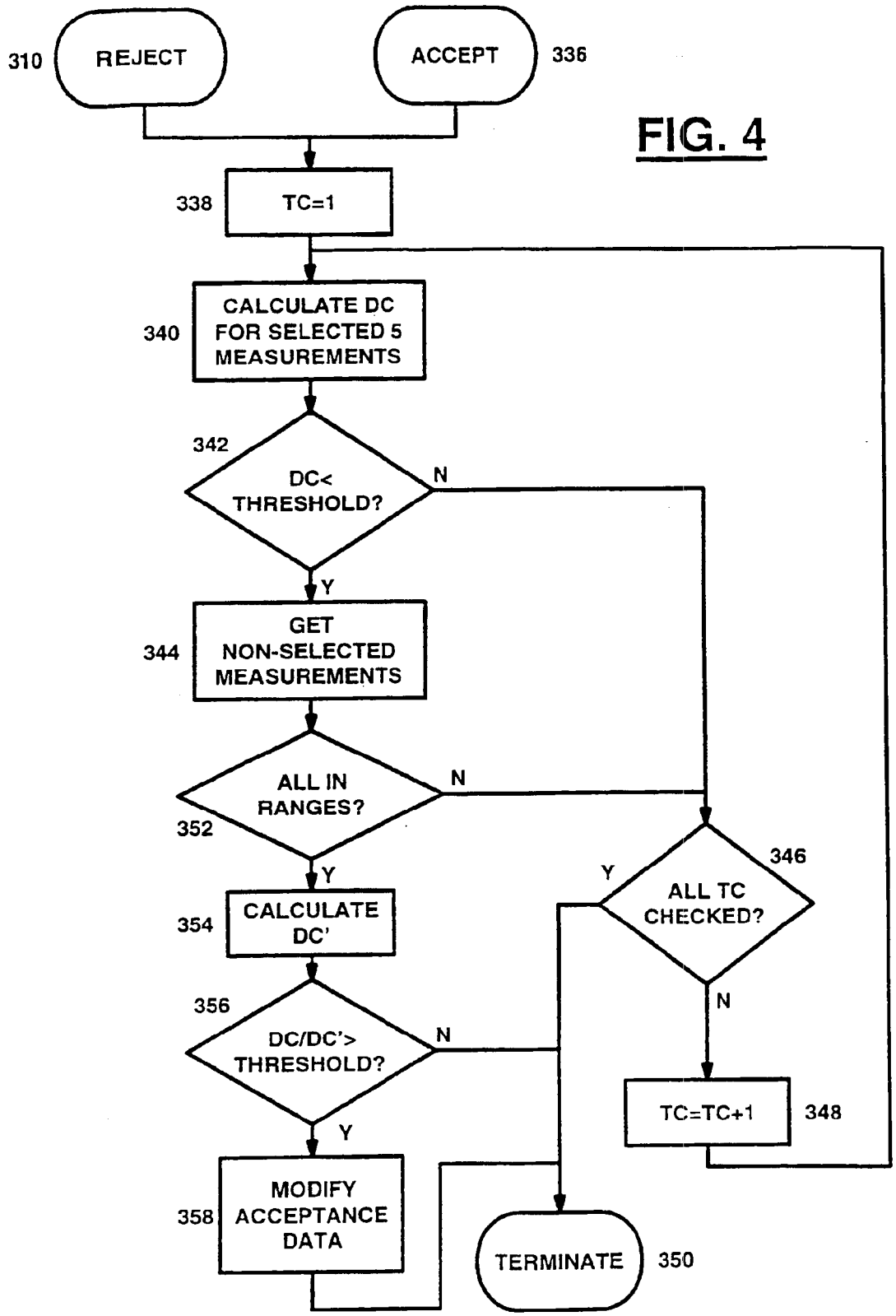
FIG. 4 is a flow chart showing an authenticity-checking operation of the validator.

Various modifications may be made to the arrangements described above, including but not limited to the following:

(a) In the verification procedure of FIG. 4, each article, whether rejected or accepted, is checked to see whether it belongs to any one of all the target classes. Alternatively, the article may be checked against only one or more selected target classes. For example, it is possible to take into account the results of the tests performed in the acceptance procedure so that in the verification procedure of FIG. 4 the article is checked only against target classes which are considered to be possible candidates on the basis of those acceptance tests. Thus, an accepted coin could be checked only against the target class to which it was deemed to belong during the acceptance procedure, and a rejected article could be tested only against the target class which it was found to most closely resemble during the acceptance procedure. It is, however, important to allow re-classification of at least some articles, especially rejected articles, having regard to the fact that the five-parameter Mahalanobis distance calculation, based on selected parameters, which is performed during the verification procedure of FIG. 4, is likely to be more reliable than the acceptance procedure of FIG. 3.

(b) If the apparatus is arranged such that articles are accepted only if they pass strict tests, then it may be unnecessary to carry out the verification procedure of FIG. 4 on accepted coins. Accordingly, it would be possible to limit the verification procedure to rejected articles. This would have the benefit that, even if genuine articles are rejected because they appear from the acceptance procedure to resemble counterfeits, they are nevertheless taken into account if they are deemed genuine during the verification procedure, so that modification of the acceptance data is not biassed.

(c) If desired the verification procedure of FIG. 4 could alternatively be used for determining whether to accept the coin. However, this would significantly increase the number of calculations required before the acceptance decision is made.

Other distance calculations can be used instead of Mahalanobis distance calculations, such as Euclidean distance calculations.

The acceptance data, including for example the means $x_m$ and the elements of the matrices M and M', can be derived in a number of ways. For example, each mechanism could be calibrated by feeding a population of each of the target classes into the apparatus and reading the measurements from the sensors, in order to derive the acceptance data. Preferably, however, the data is derived using a separate calibration apparatus of very similar construction, or a number of such apparatuses in which case the measurements from each apparatus can be processed statistically to derive a nominal average mechanism. Analysis of the data will then produce the appropriate acceptance data for storing in production validators. If, due to manufacturing tolerances, the mechanisms behave differently, then the data for each mechanism could be modified in a calibration operation. Alternatively, the sensor outputs could be adjusted by a calibration operation.

What is claimed is:

1. A method of handling an article of currency comprising determining whether the article of currency belongs to one of a plurality of target classes by performing different tests for the respective target classes, each test involving processing a selection of derived measurements of the article with acceptance data representing the correlation between those measurements in a population of the respective target class, wherein the selection of measurements is different for different target classes.

2. A method as claimed in claim 1, including the step of individually checking non-selected measurements against acceptance data for said one target class.

3. A method as claimed in claim 1, further comprising, when a first test indicates that the article belongs to a first target class, performing a second test to determine whether the article belongs to a second target class, and using a result of the second test to decide whether a result of the first test was correct.

4. A method as claimed in claim 1, in which the processing involves calculating a Mahalanobis distance.

5. A method as claimed in claim 1, including the further step of modifying the acceptance data for a target class in response to classifying an article.

6. A method as claimed in claim 5, the method comprising the following steps in the named sequence:

(a) performing a first determination of whether the article belongs to one of a plurality of target classes;

(b) deciding whether to accept or reject the article;

(c) performing a second determination of whether the article belongs to said one target class using a test which was not used as part of the first determination; and (d) modifying the acceptance data for one of said target classes in dependence on the results of the second determination.

7. A method as claimed in claim 5, the method comprising the following steps in the named sequence:

(a) performing a first determination of whether the article belongs to one of a plurality of target classes;

(b) deciding whether to accept or reject the article;

(c) performing a second determination of whether the article belongs to one of said plurality of target classes by performing said different tests; and (d) modifying the acceptance data for one of said target classes in dependence on the results of the second determination.

8. A method as claimed in claim 6 or 7, wherein the second determination is carried out in respect of an article for which a rejection decision has been made.

9. A method of handling an article of currency, the method comprising:

(a) performing a first determination as to whether the article belongs to one of a plurality of target classes by using derived measurements of the article and acceptance data for the respective class;

(b) deciding whether to accept or reject the article;

(c) then performing a second determination of whether the article belongs to said one target class, the second determination involving a test which was not performed as part of the first determination, and being performed on an article which was deemed by the first determination not to belong to said one target class; and (d) modifying acceptance data relating to at least one of the target classes in dependence on the results of the second determination.

10. A method as claimed in claim 9, wherein the second determination involves a correlation calculation using a plurality of measurements of the article and acceptance data representing the correlation between those measurements in a population of the target class.

11. A method as claimed in claim 10, including the step of selecting the measurements to use in the correlation calculation in dependence on the target class.

12. A method as claimed in claim 9, wherein step (d) comprising modifying the acceptance data for the target class to which the article has been found to belong by said second determination.

13. A method as claimed in claim 9, wherein step (d) comprises modifying the acceptance data for a target class relating to articles which would be accepted at step (b) in response to a first determination that the article belongs to that target class.

14. A method as claimed in claim 9, including the step of performing both first and second determinations for each of said plurality of target classes.

15. A method as claimed in claim 9, wherein the second determination is performed on all articles for which a first determination has been performed.

16. A method as claimed in claim 1 or 9, when used for validating coins.

17. A method as claimed in claim 1 or 9, when used for validating banknotes.

18. Apparatus for handling articles of currency, the apparatus being arranged to operate in accordance with the method of claim 1 or claim 9.

* * * * *